US006363726B1

(12) United States Patent
Durbin et al.

(10) Patent No.: US 6,363,726 B1
(45) Date of Patent: Apr. 2, 2002

(54) MIXER HAVING MULTIPLE SWIRLERS

(75) Inventors: Mark David Durbin, Springboro; Timothy James Held, Blanchester; Hukam Chand Mongia, West Chester, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/675,666

(22) Filed: Sep. 29, 2000

(51) Int. Cl.[7] ..... F23R 3/60
(52) U.S. Cl. ..... 60/748
(58) Field of Search ..... 60/746, 747, 748

(56) References Cited

U.S. PATENT DOCUMENTS

| | | | | |
|---|---|---|---|---|
| 2,551,276 A | | 5/1951 | McMahan | |
| 2,968,925 A | | 1/1961 | Blevans et al. | |
| 3,302,399 A | | 2/1967 | Tini et al. | |
| 3,474,970 A | | 10/1969 | Simmons et al. | |
| 3,630,024 A | | 12/1971 | Hopkins | |
| 3,638,865 A | | 2/1972 | McEneny et al. | |
| 3,899,884 A | | 8/1975 | Ekstedt | |
| 3,980,233 A | | 9/1976 | Simmons et al. | |
| 4,105,163 A | | 8/1978 | Davis, Jr. et al. | |
| 4,198,815 A | | 4/1980 | Bobo et al. | |
| 4,418,543 A | | 12/1983 | Faucher et al. | |
| 4,584,834 A | | 4/1986 | Koshoffer et al. | |
| 4,726,192 A | | 2/1988 | Willis et al. | |
| 4,974,416 A | | 12/1990 | Taylor | |
| 5,020,329 A | | 6/1991 | Ekstedt et al. | |
| 5,321,950 A | | 6/1994 | Shekleton et al. | |
| 5,435,884 A | | 7/1995 | Simmons et al. | |
| 5,540,056 A | | 7/1996 | Heberling et al. | |
| 5,623,827 A | * | 4/1997 | Monty | 60/748 |
| 6,082,111 A | * | 7/2000 | Stokes | 60/737 |

OTHER PUBLICATIONS

U.S. patent application Ser. No. 60/176,379, filed Jan. 14, 2000, entitled, "Method and Apparatus for Decreasing Combustor Emissions."

U.S. patent application Ser. No. 09/054,794, filed Apr. 3, 1998, entitled, "Anti–Carboning Fuel–Air Mixer for a Gas Turbine Engine Combustor."

* cited by examiner

*Primary Examiner*—Charles G. Freay
*Assistant Examiner*—Ehud Gartenberg
(74) *Attorney, Agent, or Firm*—Andrew C. Hess; William Scott Andes

(57) ABSTRACT

A mixer assembly for use in a combustion chamber of a gas turbine engine. The assembly includes a pilot mixer and a main mixer. The pilot mixer includes an annular pilot housing having a hollow interior, a pilot fuel nozzle mounted in the housing and adapted for dispensing droplets of fuel to the hollow interior of the pilot housing, and one or more axial swirlers positioned upstream from the pilot fuel nozzle. The main mixer includes a main housing surrounding the pilot housing and defining an annular cavity, an annular fuel injector having a plurality of fuel injection ports arranged in a circular pattern surrounding the pilot housing and mounted inside the annular cavity of the main mixer for releasing droplets of fuel into swirling air downstream from the fuel injector, and one or more axial swirlers positioned upstream from the plurality of fuel injection ports.

14 Claims, 4 Drawing Sheets

MIXER HAVING MULTIPLE SWIRLERS

BACKGROUND OF THE INVENTION

The present invention relates generally to gas turbine engine combustors, and more particularly to a combustor including a mixer having multiple injectors.

Fuel and air are mixed and burned in combustors of aircraft engines to heat flowpath gases. The combustors include an outer liner and an inner liner defining an annular combustion chamber in which the fuel and air are mixed and burned. A dome mounted at the upstream end of the combustion chamber includes mixers for mixing fuel and air. Ignitors mounted downstream from the mixers ignite the mixture so it burns in the combustion chamber.

Governmental agencies and industry organizations regulate the emission of nitrogen oxides (NOx), unburned hydrocarbons (HC), and carbon monoxide (CO) from aircraft. These emissions are formed in the combustors and generally fall into two classes, those formed due to high flame temperatures and those formed due to low flame temperatures. In order to minimize emissions, the reactants must be well mixed so that burning will occur evenly throughout the mixture without hot spots which increase NOx emissions or cold spots which increase CO and HC emissions. Thus, there is a need in the industry for combustors having improved mixing and reduced emissions.

Some prior art combustors such as rich dome combustors 10 as shown in FIG. 1 have mixers 12 which provide a rich fuel-to-air ratio adjacent an upstream end 14 of the combustor. Because additional air is added through dilution holes 16 in the combustor 10, the fuel-to-air ratio is lean at a downstream end 18 of a combustor opposite the upstream end 14. In order to improve engine efficiency and reduce fuel consumption, combustor designers have increased the operating pressure ratio of the gas turbine engines. However, as the operating pressure ratios increase, the combustor temperatures increase. Eventually the temperatures and pressures reach a threshold at which the fuel-air reaction occurs much faster than mixing. This results in local hot spots and increased NOx emissions.

Lean dome combustors 20 as shown in FIG. 2 have the potential to prevent local hot spots. These combustors 20 have two rows of mixers 22, 24 allowing the combustor to be tuned for operation at different conditions. The outer row of mixers 24 is designed to operate efficiently at idle conditions. At higher power settings such as takeoff and cruise, both rows of mixers 22, 24 are used, although the majority of fuel and air are supplied to the inner row of mixers. The inner mixers 22 are designed to operate most efficiently with lower NOx emissions at high power settings. Although the inner and outer mixers 22, 24 are optimally tuned, the regions between the mixers may have cold spots which produce increased HC and CO emissions.

SUMMARY OF THE INVENTION

Among the several features of the present invention may be noted the provision of a mixer assembly for use in a combustion chamber of a gas turbine engine. The assembly includes a pilot mixer and a main mixer. The pilot mixer includes an annular pilot housing having a hollow interior, a pilot fuel nozzle mounted in the housing and adapted for dispensing droplets of fuel to the hollow interior of the pilot housing, and one or more axial swirlers positioned upstream from the pilot fuel nozzle. Each of the pilot mixer swirlers has a plurality of vanes for swirling air traveling through the swirler to mix air and the droplets of fuel dispensed by the pilot fuel nozzle. The main mixer includes a main housing surrounding the pilot housing and defining an annular cavity, an annular fuel injector having a plurality of fuel injection ports arranged in a circular pattern surrounding the pilot housing and mounted inside the annular cavity of the main mixer for releasing droplets of fuel into swirling air downstream from the fuel injector, and one or more axial swirlers positioned upstream from the plurality of fuel injection ports. Each of the main mixer swirlers has a plurality of vanes for swirling air traveling through the swirler to mix air and the droplets of fuel dispensed by the fuel injection ports.

In another aspect, the mixer assembly of the present invention includes a main mixer having a plurality of swirlers positioned upstream from the plurality of fuel injection ports. Each of the main mixer swirlers has a plurality of vanes for swirling air traveling through the respective swirler to mix air and the droplets of fuel dispensed by the fuel injection ports.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
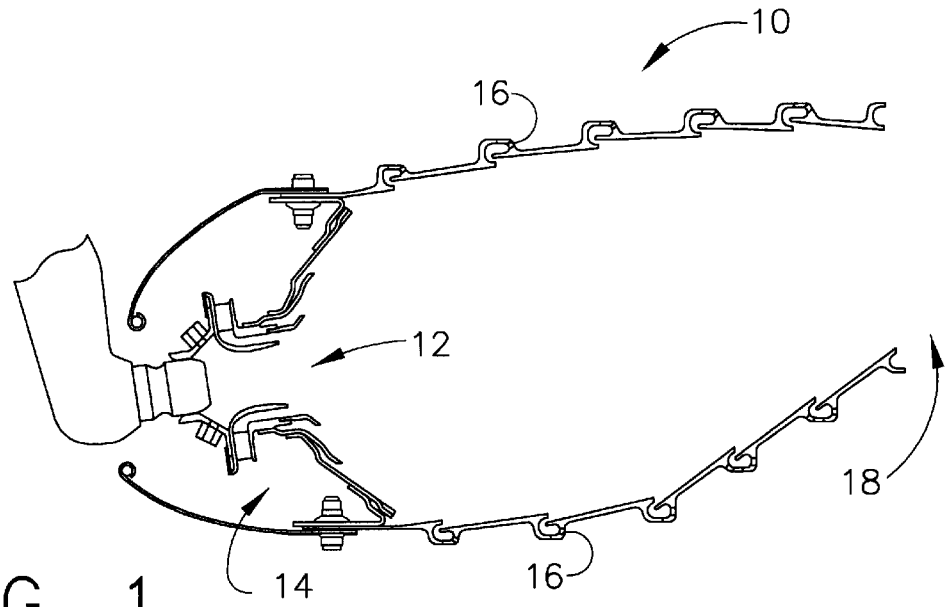
FIG. 1 (PRIOR ART)
FIG. 1 is a vertical cross section of an upper half of a conventional rich dome combustor.
Figure 2:
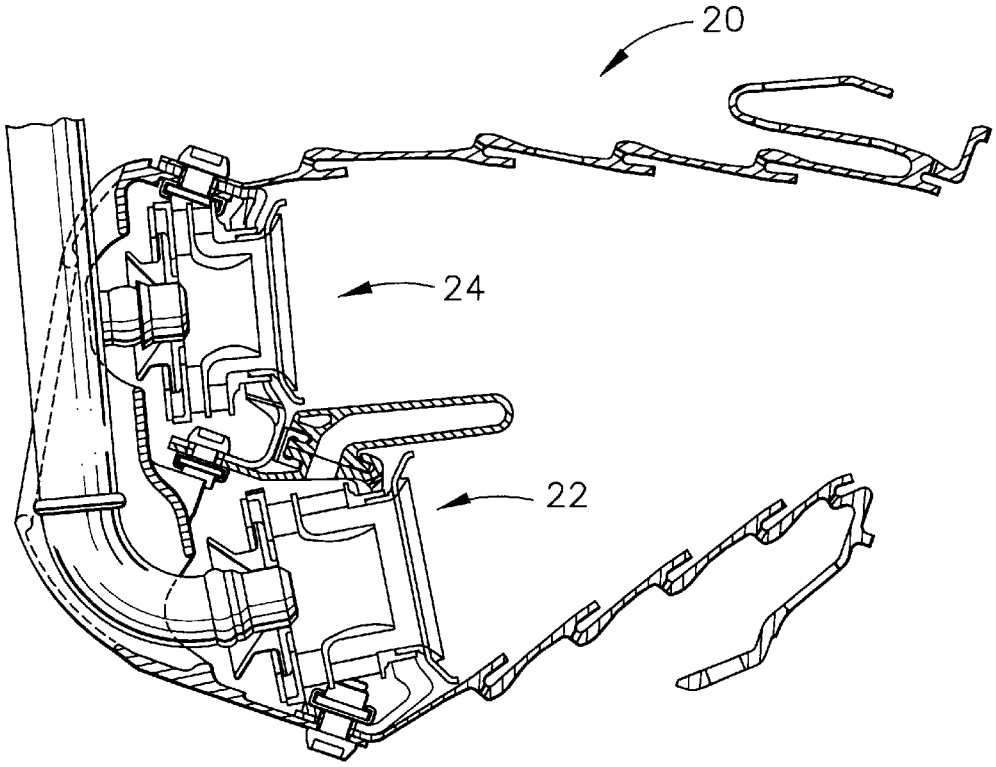
FIG. 2 (PRIOR ART)
FIG. 2 is a vertical cross section of an upper half of a conventional lean dome combustor.
Figure 3:
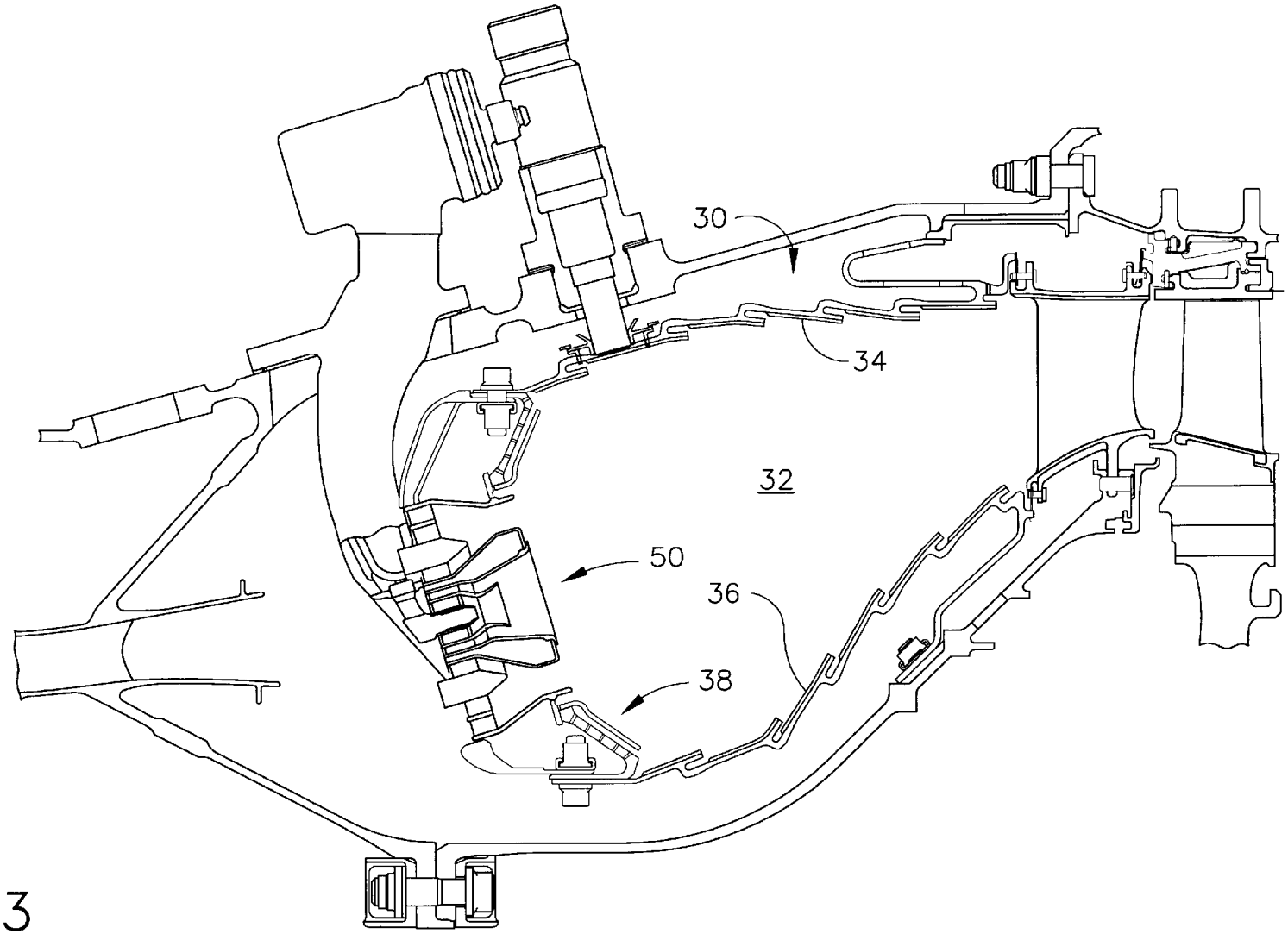
FIG. 3 is a vertical cross section of an upper half of a combustor of the present invention.

Referring to the drawings and in particular to FIG. 3, a combustor of the present invention is designated in its entirety by the reference number 30. The combustor 30 has a combustion chamber 32 in which combustor air is mixed with fuel and burned. The combustor 30 includes an outer liner 34 and an inner liner 36. The outer liner 34 defines an outer boundary of the combustion chamber 32, and the inner liner 36 defines an inner boundary of the combustion chamber. An annular dome, generally designated by 38, mounted upstream from the outer liner 34 and the inner liner 36 defines an upstream end of the combustion chamber 32. Mixer assemblies or mixers of the present invention, generally designated by 50, are positioned on the dome 38. The mixer assemblies 50 deliver a mixture of fuel and air to the combustion chamber 32. Other features of the combustion chamber 30 are conventional and will not be discussed in further detail.

Figure 4:
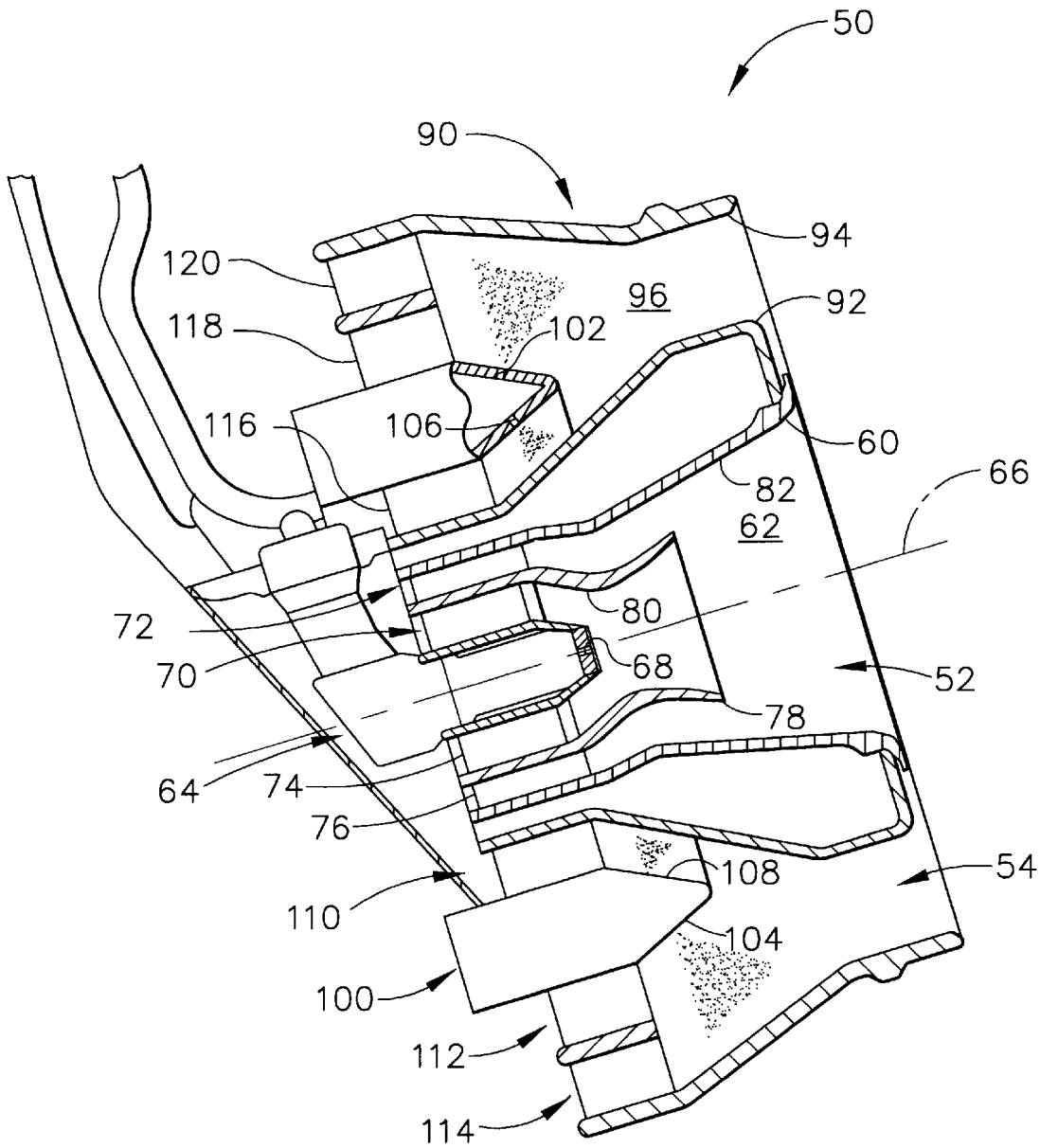
FIG. 4 is a vertical cross section of a mixer assembly of a first embodiment of the present invention.

As illustrated in FIG. 4, each mixer assembly 50 generally comprises a pilot mixer, generally designated by 52, and a main mixer, generally designated by 54, surrounding the pilot mixer. The pilot mixer 52 includes an annular pilot housing 60 having a hollow interior 62. A pilot fuel nozzle, generally designated by 64, is mounted in the housing 60 along a centerline 66 of the mixer 50. The nozzle 64 includes a fuel injector 68 adapted for dispensing droplets of fuel into the hollow interior 62 of the pilot housing 60. It is envisioned that the fuel injector 68 may include an injector such as described in U.S. Pat. No. 5,435,884, which is hereby incorporated by reference.

The pilot mixer 52 also includes a pair of concentrically mounted axial swirlers, generally designated by 70, 72, having a plurality of vanes 74, 76, respectively, positioned upstream from the pilot fuel nozzle 64. Although the swirlers 70, 72 may have different numbers of vanes 74, 76 without departing from the scope of the present invention, in one embodiment the inner pilot swirler has 10 vanes and the outer pilot swirler has 10 vanes. Each of the vanes 74, 76 is skewed relative to the centerline 66 of the mixer 50 for swirling air traveling through the pilot mixer 52 so it mixes with the droplets of fuel dispensed by the pilot fuel nozzle 64 to form a fuel-air mixture selected for optimal burning during ignition and low power settings of the engine. Although the pilot mixer 52 of the disclosed embodiment has two axial swirlers 70, 72, those skilled in the art will appreciate that the mixer may include more swirlers without departing from the scope of the present invention. As will further be appreciated by those skilled in the art, the swirlers 70, 72 may be configured alternatively to swirl air in the same direction or in opposite directions. Further, the pilot interior 62 may be sized and the pilot inner and outer swirler 70, 72 airflows and swirl angles may be selected to provide good ignition characteristics, lean stability and low CO and HC emissions at low power conditions.

A cylindrical barrier 78 is positioned between the swirlers 70, 72 for separating airflow traveling through the inner swirler 70 from that flowing through the outer swirler 72. The barrier 78 has a converging-diverging inner surface 80 which provides a fuel filming surface to aid in low power performance. Further, the housing 60 has a generally diverging inner surface 82 adapted to provide controlled diffusion for mixing the pilot air with the main mixer airflow. The diffusion also reduces the axial velocities of air passing through the pilot mixer 52 and allows recirculation of hot gasses to stabilize the pilot flame.

The main mixer 54 includes a main housing, generally designated by 90, comprising an inner shell 92 and an outer shell 94 surrounding the pilot housing 60 so the housing defines an annular cavity 96. The inner shell 92 and outer shell 94 converge to provide thorough mixing without auto-ignition. An annular fuel injector, generally designated by 100, is mounted between the pilot inner shell 92 and the outer shell 94. The injector 100 has a plurality of outward facing fuel injection ports 102 on its exterior surface 104 and a plurality of inward facing fuel injection ports 106 on its interior surface 108 for introducing fuel into the cavity 96 of the main mixer 54. Although the injector 100 may have a different number of ports 102, 106 without departing from the scope of the present invention, in one embodiment the injector 100 has 20 evenly spaced outward facing ports 102 and 20 evenly spaced ports inward facing ports 106. Although each set of ports 102, 106 is arranged in a single circumferential row in the embodiment shown in FIG. 4, those skilled in the art will appreciate that they may be arranged in other configurations (e.g., in multiple rows) without departing from the scope of the present invention. As will be understood by those skilled in the art, using two rows of fuel injector ports 102, 106 at different radial locations in the main mixer cavity 96 provides flexibility to adjust the degree of fuel-air mixing to achieve low NOx and complete combustion under variable conditions. In addition, the large number of fuel injection ports in each row provides for good circumferential fuel-air mixing. Further, the different radial locations of the rows may be selected to prevent combustion instability.

It is envisioned that the fuel injection ports 102, 106 may be fed by independent fuel stages to achieve improved fuel/air ratios. The inward facing ports 106 would be fueled during approach and cruise conditions. It is expected that this would significantly improve both NOx and combustion efficiency at these conditions compared to current technology. The outward facing ports 102 would only be fueled during takeoff. In addition, it is envisioned that the fuel ports 102, 106 may be plain jets or sprayers without departing from the scope of the present invention.

The main mixer 54 also includes three concentrically mounted axial swirlers, generally designated by 110, 112, 114, having a plurality of vanes 116, 118, 120 respectively, positioned upstream from the main mixer fuel injector 100. Although the swirlers may have different numbers of vanes 116, 118, 120 without departing from the scope of the present invention, in one embodiment the inner main swirler 110 has 20 vanes, the middle main swirler 112 has 24 vanes, and the outer main swirler 114 has 28 vanes. Each of the vanes 116, 118, 120 is skewed relative to the centerline 66 of the mixer 50 for swirling air traveling through the main mixer 54 so it mixes with the droplets of fuel dispensed by the main fuel injector 100 to form a fuel-air mixture selected for optimal burning during high power settings of the engine. Although the main mixer 54 of the disclosed embodiment has three axial swirlers 110, 112, 114, those skilled in the art will appreciate that the mixer may include a different number of swirlers without departing from the scope of the present invention. Further, the main mixer 54 is primarily designed to achieve low NOx under high power conditions by operating with a lean air-fuel mixture and by maximizing the fuel and air pre-mixing.

Although the swirlers 110, 112, 114 of the main mixer 54 may have other configurations without departing from scope the present invention, in one embodiment the swirlers of the main mixer and the swirlers 70, 72 of the pilot mixer 52 are aligned in a single plane. As will be appreciated by the skilled in the art, the axial swirlers 70, 72, 110, 112, 114 of the present invention provide better discharge coefficients than radial swirlers. Thus, the axial swirlers provide required airflow in a smaller area than radial swirler and therefore minimize mixer area.

The swirlers 110, 112, 114 of the main mixer 54 swirl the incoming air and establish the basic flow field of the combustor 30. Fuel is injected radially inward and outward into the, swirling air stream downstream from the main swirlers 110, 112, 114 allowing for thorough mixing within the main mixer cavity 92 upstream from its exit. This swirling mixture enters the combustor chamber 32 where it is burned completely.

The swirlers 110, 112, 114 may be co-swirling or counter-swirling depending on the desired turbulence and exit velocity profile of the mixer 54. For instance, the inner swirler 110 may be co-swirled with the pilot swirlers 70, 72 to prevent excessive interaction which would cause higher emissions at idle power settings. The middle swirler 112 may be co-swirled with the inner swirler 110 for the same reason. However, the outer swirler 114 may be counter-swirled to create a strong shear layer which would improve mixing and lower NOx emissions at some flame temperatures. In an alternate embodiment, the inner and outer swirlers 110, 114 would be co-swirling with the inner swirler 110 and the middle swirler 112 would be counter-swirling to create two shear layers in the main mixer cavity 92 to improve mixing and lower NOx emissions. It is envisioned that this configuration may be beneficial if the shear layer interaction between the inner and middle swirlers 110, 112 is found to have little impact on the pilot and idle performance of the main mixer 54.

Figure 5:
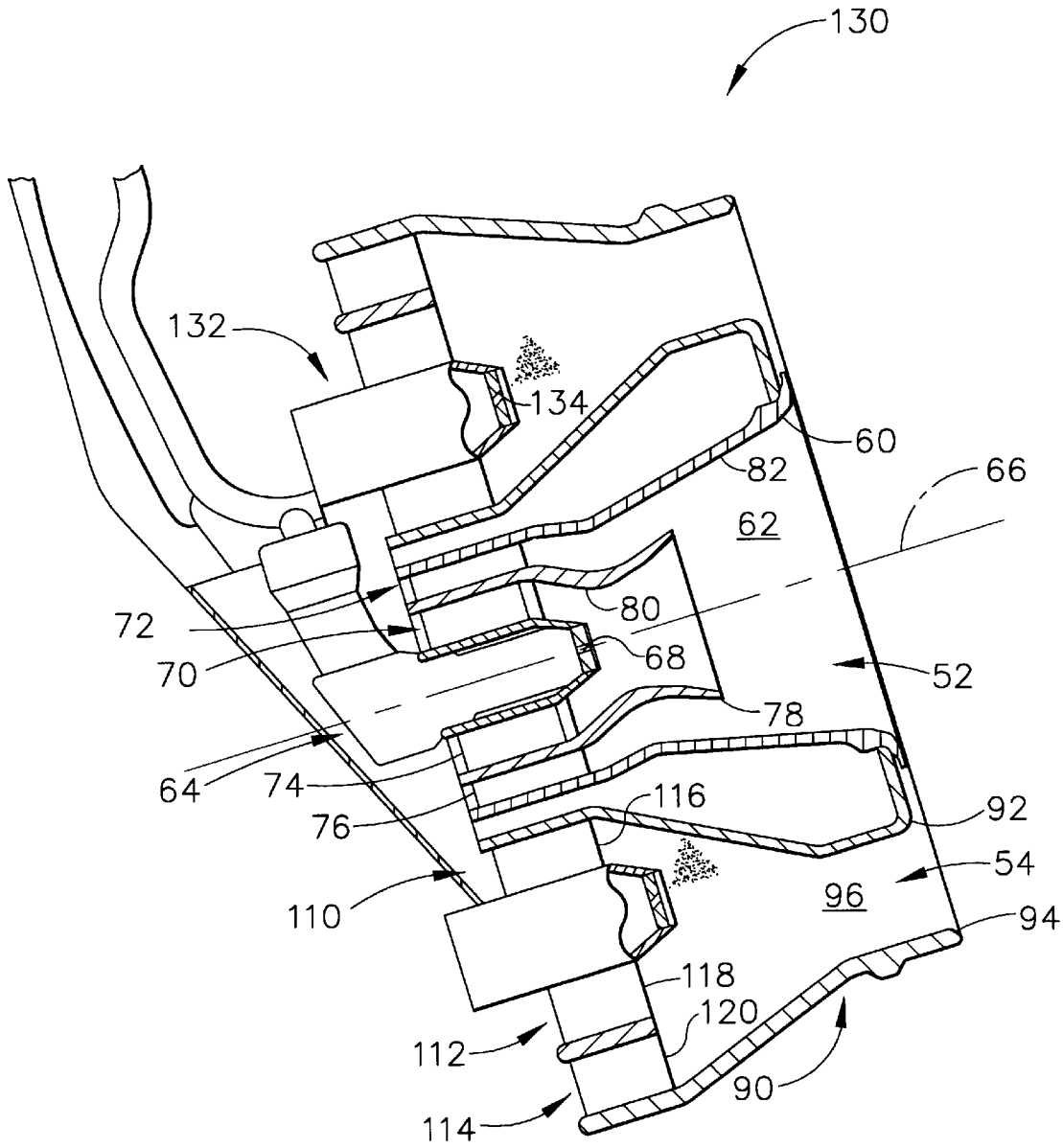
FIG. 5 is a vertical cross section of a mixer assembly of a second embodiment of the present invention.

A second embodiment of the mixer 130, shown in FIG. 5, includes a main mixer 54 having an annular fuel injector, generally designated by 132, mounted between the inner main swirler 110 and the middle main swirler 112. The injector 132 has a port 134 at its downstream end for introducing fuel into the cavity 96 of the main mixer 54. Although the injector 132 may have a different number of ports 134 without departing from the scope of the present invention, in one embodiment the injector has 20 evenly spaced ports. It is envisioned that the fuel injector 132 may include injectors such as described in U.S. Pat. No. 5,435,884. It is further envisioned that every other port 134 around the circumference of the injector 132 may be angled inboard and outboard (e.g., about 30 degrees) with respect to the centerline 66 of the mixer 130 as shown in FIG. 5 to enhance fuel-air mixing. As the mixer 130 of the second embodiment is identical to the mixer 50 of the first embodiment in all other respects, it will not be described in further detail.

In operation, only the pilot mixer 52 is fueled during starting and low power conditions where stability and low CO/HC emissions are critical. The main mixer 54 is fueled during high power operation including takeoff, climb and cruise conditions. The fuel split between the pilot and main mixers 52, 54, respectively, is selected to provide good efficiency and low NOx emissions as is well understood by those skilled in the art.

It is expected that the mixers 50, 130 described above will provide a reduction in NOx emissions of up to 70 to 80 percent during takeoff compared to 1996 International Civil Aviation Organization standards, and up to 80 to 90 percent at cruise conditions compared to currently available commercial mixers.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A mixer assembly for use in a combustion chamber of a gas turbine engine, said assembly comprising:

a pilot mixer including an annular pilot housing having a hollow interior, a pilot fuel nozzle mounted in the housing and adapted for dispensing droplets of fuel to the hollow interior of the pilot housing, and an axial swirler positioned upstream from the pilot fuel nozzle having a plurality of vanes for swirling air traveling through the respective swirler to mix air and the droplets of fuel dispensed by the pilot fuel nozzle; and a main mixer including a main housing surrounding the pilot housing and defining an annular cavity, an annular fuel injector having a plurality of fuel injection ports arranged in a circular pattern surrounding the pilot housing and mounted inside the annular cavity of said main mixer for releasing droplets of fuel into swirling air downstream from the fuel injector, and an axial swirler positioned upstream from the plurality of fuel injection ports having a plurality of vanes for swirling air traveling through the swirler to mix air and the droplets of fuel dispensed by the fuel injection ports, said main mixer swirler and said pilot mixer swirler being coaxial.

2. A mixer assembly as set forth in claim 1 wherein said pilot mixer includes at least two swirlers and the assembly further comprises a barrier positioned between two of said swirlers in the pilot mixer, said barrier having a converging inner surface downstream from said swirlers.

3. A mixer assembly as set forth in claim 2 wherein the barrier has a diverging inner surface downstream from said converging inner surface.

4. A mixer assembly as set forth in claim 1 wherein the pilot housing obstructs a clear line of sight between the pilot mixer fuel nozzle and the main housing.

5. A mixer assembly as set forth in claim 1 wherein the main mixer includes three concentrically mounted axial swirlers positioned upstream from said plurality of fuel injection ports.

6. A mixer assembly as set forth in claim 5 wherein each of said plurality of fuel injection ports in the main mixer releases droplets of fuel in a generally axial direction with respect to a centerline of the fuel injector.

7. A mixer assembly as set forth in claim 5 wherein a first portion of said plurality of fuel injection ports releases droplets of fuel in a generally outward direction relative to a centerline of the fuel injector, and a second portion of said plurality of fuel injection ports releases droplets of fuel in a generally inward direction relative to the centerline of the fuel injector.

8. A mixer assembly as set forth in claim 1 wherein the pilot mixer includes two concentrically mounted axial swirlers positioned upstream from the pilot fuel nozzle.

9. A mixer assembly as set forth in claim 1 in combination with a combustion chamber comprising:

an annular outer liner defining an outer boundary of the combustion chamber;

an annular inner liner mounted inside the outer liner and defining an inner boundary of the combustion chamber; and an annular dome mounted upstream from the outer liner and the inner liner and defining an upstream end of the combustion chamber, said mixer assembly being mounted on the dome for delivering a mixture of fuel and air to the combustion chamber.

10. A mixer assembly for use in a combustion chamber of a gas turbine engine, said assembly comprising:

a pilot mixer including an annular pilot housing having a hollow interior, a pilot fuel nozzle mounted in the housing and adapted for dispensing droplets of fuel to the hollow interior of the pilot housing, and a plurality of axial swirlers positioned upstream from the pilot fuel nozzle, each of said plurality of swirlers having a plurality of vanes for swirling air traveling through the respective swirler to mix air and the droplets of fuel dispensed by the pilot fuel nozzle; and a main mixer including a main housing surrounding the pilot housing and defining an annular cavity, an annular fuel injector having a plurality of fuel injection ports arranged in a circular pattern surrounding the pilot housing and mounted inside the annular cavity of said main mixer for releasing droplets of fuel into swirling air downstream from the fuel injector, and a plurality of swirlers positioned upstream from the plurality of fuel injection ports, each of said main mixer swirlers having a plurality of vanes for swirling air traveling through the respective swirler to mix air and the droplets of fuel dispensed by the fuel injection ports, at least one of said main mixer swirlers and at least one of said pilot mixer swirlers being coaxial.

11. A mixer assembly as set forth in claim 10 wherein each of said plurality of vanes of a first swirler of said plurality of main mixer swirlers extends radially outward from the annular fuel injector, and each of said vanes of a second swirler of said plurality of swirlers extends radially inward from the annular fuel injector toward a centerline thereof.

12. A mixer assembly as set forth in claim 11 wherein each of said plurality of vanes of a third swirler of said plurality of swirlers in the main mixer extends radially outward from said first swirler.

13. A mixer assembly as set forth in claim 12 wherein each of said plurality of swirlers in the main mixer and each of said swirlers of said pilot mixer are aligned in a single plane.

14. A mixer assembly as set forth in claim 10 in combination with a combustion chamber comprising:

an annular outer liner defining an outer boundary of the combustion chamber;

an annular inner liner mounted inside the outer liner and defining an inner boundary of the combustion chamber; and an annular dome mounted upstream from the outer liner and the inner liner and defining an upstream end of the combustion chamber, said mixer assembly being mounted on the dome for delivering a mixture of fuel and air to the combustion chamber.

* * * * *